US008616145B1

(12) United States Patent
Ferran

(10) Patent No.: US 8,616,145 B1
(45) Date of Patent: Dec. 31, 2013

(54) SNAP ON FLAG POLE

(76) Inventor: George Ferran, Miami, FL (US)

( * ) Notice: Subject to any disclaimer, the term of this patent is extended or adjusted under 35 U.S.C. 154(b) by 350 days.

(21) Appl. No.: 13/112,072

(22) Filed: May 20, 2011

(51) Int. Cl.
*G09F 17/00* (2006.01)

(52) U.S. Cl.
USPC ..... 116/28 R; 116/173

(58) Field of Classification Search
USPC ..... 116/28 R, 173, 174; 40/591, 592, 599, 40/607.11, 607.12, 611.12; 24/74.2, 336, 24/339, 460, 462, 545, 546, 563; D11/166, 182
See application file for complete search history.

(56) References Cited

U.S. PATENT DOCUMENTS

| | | | | | |
|---|---|---|---|---|---|
| 1,871,690 | A * | 8/1932 | Hogan | 40/607.11 |
| 3,762,360 | A * | 10/1973 | Hawes | 116/28 R |
| 4,163,426 | A * | 8/1979 | O'Neill | 116/28 R |
| 4,590,883 | A * | 5/1986 | Steed et al. | 116/173 |
| 5,544,850 | A * | 8/1996 | Fankhauser | 248/164 |
| 5,711,245 | A * | 1/1998 | Knirck | 116/28 R |
| 6,405,414 | B1 * | 6/2002 | Byrnes et al. | 24/339 |
| D475,677 | S * | 6/2003 | Zucker | D12/223 |
| 6,935,268 | B1 * | 8/2005 | Hawkins | 116/173 |
| 7,066,105 | B2 * | 6/2006 | Tal | 116/28 R |
| 7,540,548 | B2 * | 6/2009 | Haas et al. | 296/21 |
| 7,594,583 | B2 * | 9/2009 | Whipple | 220/86.2 |
| 7,721,396 | B2 * | 5/2010 | Fleischman | 24/460 |
| 7,878,139 | B1 * | 2/2011 | Karnes et al. | 116/28 R |
| 7,886,406 | B2 * | 2/2011 | Chang | 16/252 |
| 8,083,188 | B2 * | 12/2011 | Kittle et al. | 248/74.2 |
| 8,141,839 | B2 * | 3/2012 | Buchner | 248/516 |
| 8,430,052 | B2 * | 4/2013 | Nihra et al. | 116/173 |
| 2003/0084835 | A1 * | 5/2003 | Chao | 116/173 |
| 2004/0173721 | A1 * | 9/2004 | Kahan | 248/314 |
| 2010/0233934 | A1 * | 9/2010 | Tonary et al. | 446/217 |
| 2011/0226911 | A1 * | 9/2011 | Lambert et al. | 248/65 |
| 2012/0210930 | A1 * | 8/2012 | Lupoff | 116/173 |

FOREIGN PATENT DOCUMENTS

| | | | | |
|---|---|---|---|---|
| CH | 603389 A * | 8/1978 | | G09F 17/00 |
| CN | 201261433 Y * | 6/2009 | | G09F 17/00 |
| DE | 20112497 U1 * | 10/2001 | | B60R 13/00 |
| GB | 2377681 A * | 1/2003 | | B60R 13/00 |

* cited by examiner

*Primary Examiner* — Peter Macchiarolo
(74) *Attorney, Agent, or Firm* — Albert Bordas, P.A.

(57) ABSTRACT

A flagpole having a shaft assembly comprising first and second ends. The first end defines a head. Positioned between the head and the second end is a channel. A snap cap has an exterior sidewall with a top face and an exterior bottom edge. An interior sidewall extends from the top face to an interior bottom wall. The interior bottom wall comprises an edge that protrudes inwardly from the interior sidewall. At least two notches are defined at the top face. The at least two notches extend along the interior sidewall to the interior bottom wall. A clamp assembly has a shaft member with third and fourth ends. The third end extends from the second end. Extending from the fourth end is a connector section that terminates as a clamp. In use, the flagpole is mounted onto a tubular section of vessel to display a flag mounted thereon.

17 Claims, 4 Drawing Sheets

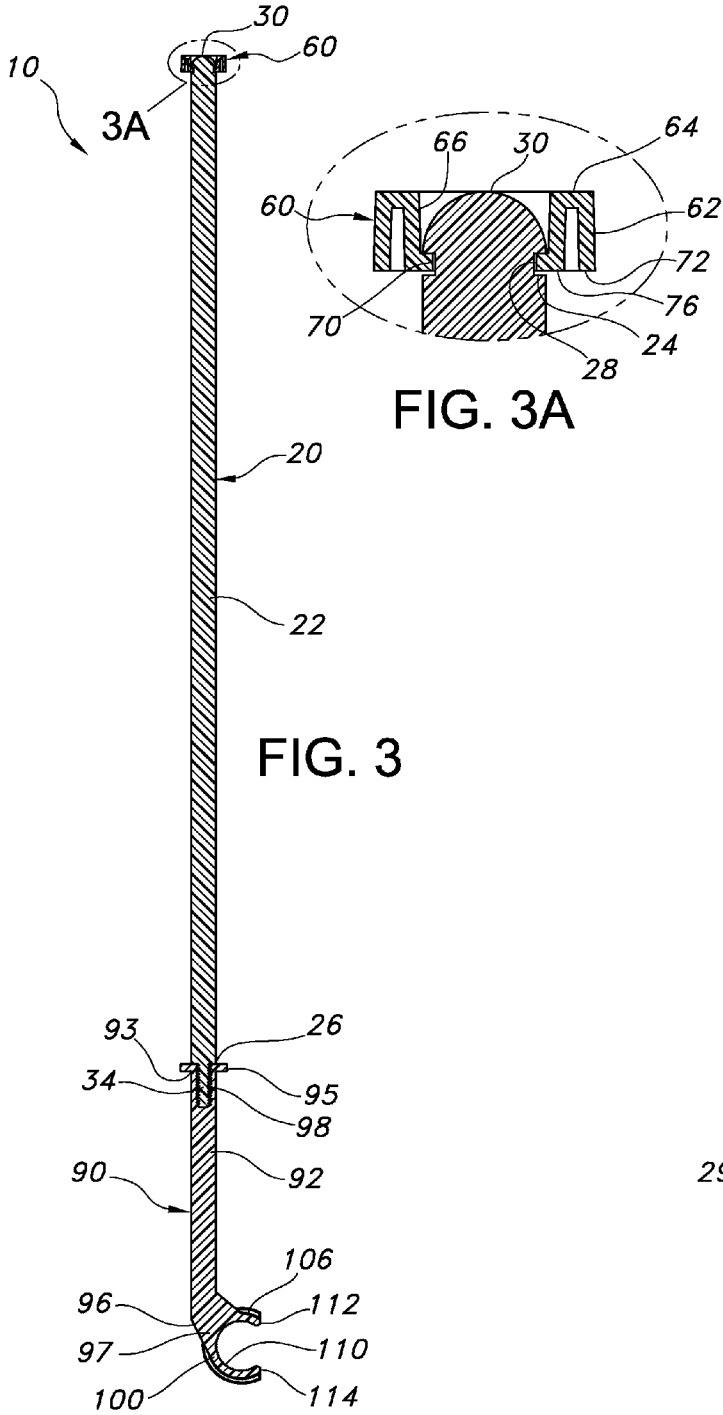
FIG. 3A
FIG. 3
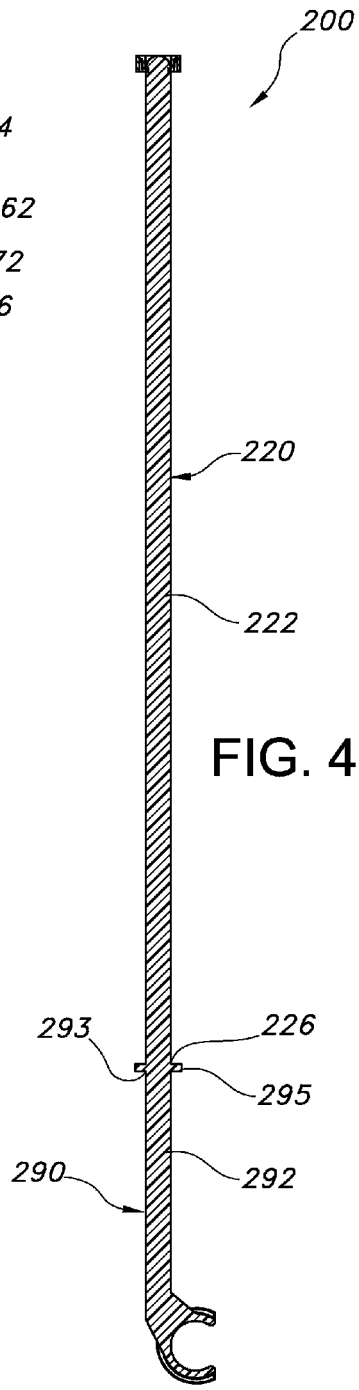
FIG. 4

SNAP ON FLAG POLE

BACKGROUND OF THE INVENTION

1. Field of the Invention

The present invention relates to flagpoles, and more particularly, to a snap on flagpole that can be mounted to a vessel.

2. Description of the Related Art

Over the years, displaying flags has become popular for holidays, showing support for sports teams, showing patriotism, and for acknowledging a multitude of events. In some cases, flag displaying is mandatory, such as while aboard a sea vessel such as a boat or yacht. Permanent flag mounting systems are typical. However, Applicant is not aware of a snap on flagpole having the innovative features of the present invention.

SUMMARY OF THE INVENTION

The instant invention is a flagpole, comprising first and second ends. The first end has a head thereon. Positioned between the head and the second end is a channel. A snap cap has an exterior sidewall with a top face and an exterior bottom edge. An interior sidewall extends from the top face to an interior bottom wall. The interior bottom wall comprises an edge that protrudes inwardly from the interior sidewall. At least two notches are defined at the top face. The at least two notches extend along the interior sidewall to the interior bottom wall. A clamp assembly has a shaft member with third and fourth ends. The third end extends from the second end. Extending from the fourth end is a connector section that terminates as a clamp. In use, the flagpole is mounted onto a tubular section of a vessel to display a flag mounted thereon.

The clamp comprises first and second lateral ends. The first and second lateral ends have respective first and second lateral flanges. The channel receives the edge when the cap is forced over the head with a predetermined force. The clamp is perpendicular to the shaft assembly and the shaft member. The exterior sidewall is parallel to the interior sidewall. The first and second lateral ends and their respective first and second lateral flanges each define a "C" shape. The at least two notches are positioned opposite with respect to each other. The clamp has a hatched section that defines a clamp interior face. The clamp mounts onto a structure of cooperative dimensions and shape to display a flag mounted on the shaft assembly. The shaft assembly has a substantially elongated cylindrical shape. A threaded bolt protrudes from the second end and the third end comprises a threaded hole.

It is therefore one of the main objects of the present invention to provide a snap on flagpole that can be removably mounted to vessels to display at least one flag.

It is another object of this invention to provide a snap on flagpole that enables for quick and easy flag replacement.

It is another object of this invention to provide a snap on flagpole that is volumetrically efficient for carrying, transporting, and storage.

It is another object of this invention to provide a snap on flagpole that can be readily assembled and disassembled without the need of any special tools.

It is another object of this invention to provide a snap on flagpole, which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 3 is a longitudinal cross section view taken along lines 3-3 from FIG. 1.

FIG. 3A is an enlarged view taken along line 3A from FIG. 3, showing the details of the snap cap mounted onto the head.

FIG. 4 is a longitudinal cross section view of an alternate embodiment for the present invention.

DETAILED DESCRIPTION OF THE PREFERRED EMBODIMENT

Figure 1:
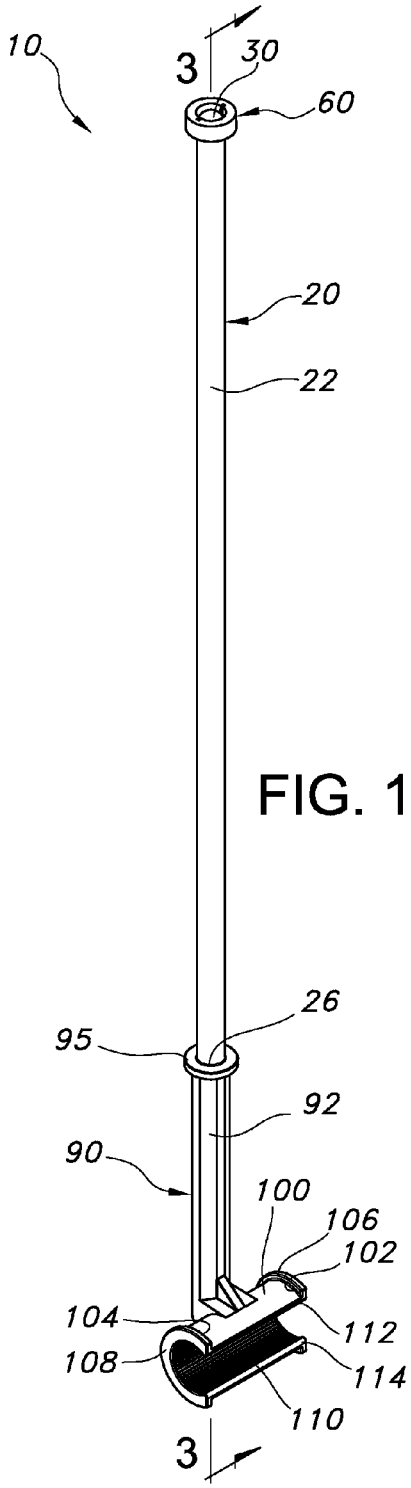
FIG. 1 is a front isometric view of the instant application.

Referring now to the drawings, the present invention is generally referred to with numeral 10. It can be observed that it basically includes shaft assembly 20, snap cap 60, and clamp assembly 90.

Figure 2:
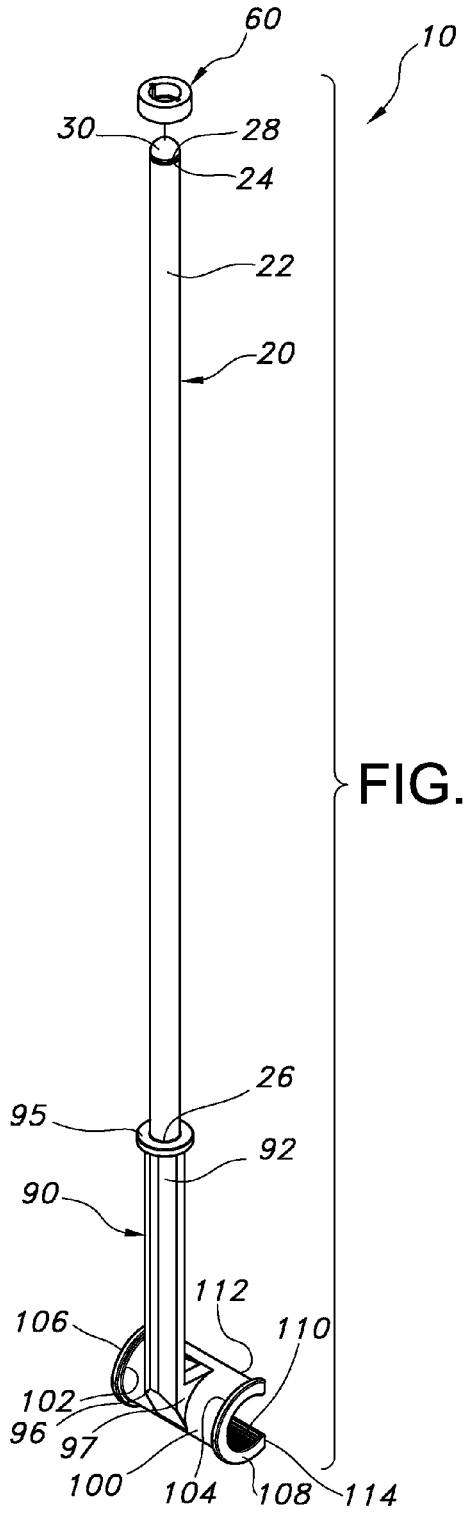
FIG. 2 is a rear isometric exploded view of the present invention.

As seen in FIGS. 1 and 2, shaft assembly 20 comprises first end 24 and second end 26. Extending from first end 24 is head 30. Positioned between head 30 and second end 26 is channel 28. Shaft assembly 20 further comprises wall 22. Clamp assembly 90 comprises shaft member 92 having third end 93 and fourth end 96. Third end 93 extends from second end 26. Extending from fourth end 96 is connector section 97 that terminates as clamp 100. Clamp 100 comprises edges 112 and 114, and first lateral end 102 and second lateral end 104. First lateral end 102 has first lateral flange 106, and second lateral end 104 has second lateral flange 108. First lateral end 102 and first lateral flange 106, and second lateral end 104 and second lateral flange 108 each define a "C" shape. Clamp 100 is perpendicular to clamp assembly 90 and shaft member 92. Clamp 100 has hatched section 110 that defines a clamp interior face.

As best seen in FIG. 3, threaded bolt 34 protrudes from second end 26 and third end 93 comprises threaded hole 98. In addition, second end 26 may comprise flange 95.

As best seen in FIG. 3A, channel 28 receives edge 70 when snap cap 60 is forced onto head 30 with a predetermined force.

Seen in FIG. 4 is an alternate embodiment of instant invention 10 defined as 200, whereby it comprises shaft assembly 220 having end 226 and wall 222. Clamp assembly 290 comprises shaft member 292 having end 293. In this embodiment 200, ends 226 and 293 are joined at flange 295 as a single piece and without a nut or hole and bolt assembly. The rest of the components are identical to the preferred embodiment 10.

Figure 5:
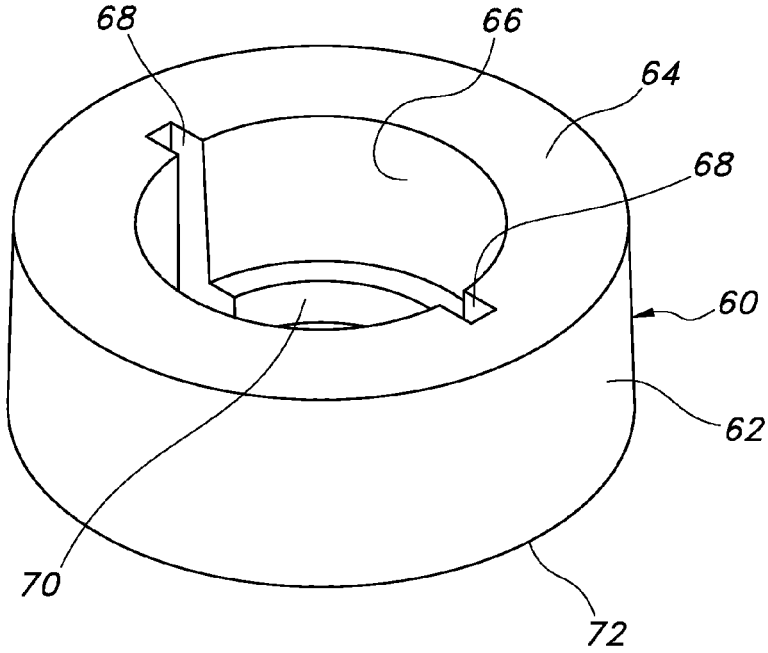
FIG. 5 is a top isometric view of the snap cap.
Figure 6:
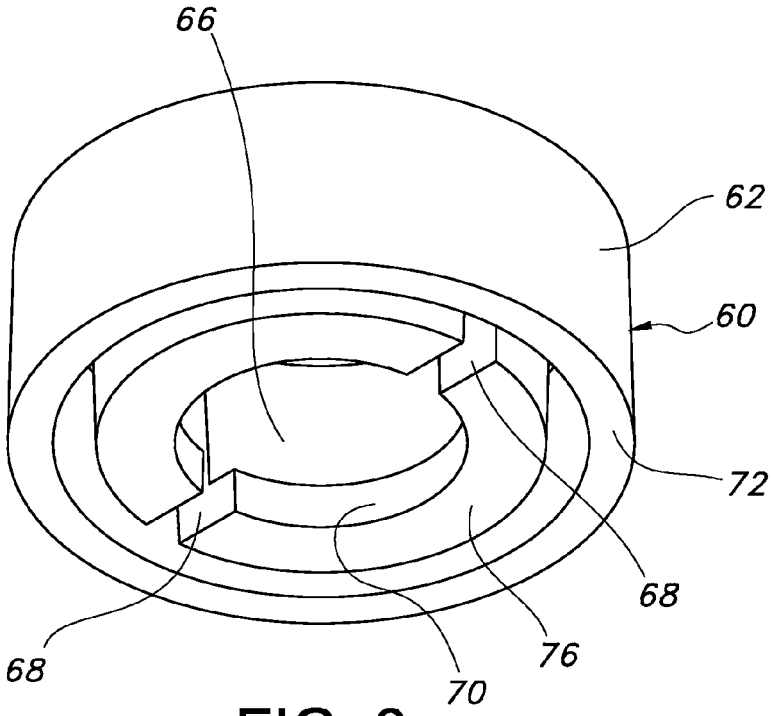
FIG. 6 is a bottom isometric view of the snap cap.

As best seen in FIGS. 5 and 6, snap cap 60 comprises exterior sidewall 62 having top face 64 and exterior bottom edge 72. Interior sidewall 66 extends from top face 64 to interior bottom wall 76. Interior bottom wall 76 comprises edge 70 that protrudes inwardly a predetermined distance from interior sidewall 66. At least two notches 68 are defined at top face 64. At least two notches 68 extend along interior sidewall 66 to interior bottom wall 76. At least two notches 68 are positioned opposite with respect to each other, and exterior sidewall 62 is parallel to interior sidewall 66.

Figure 7:
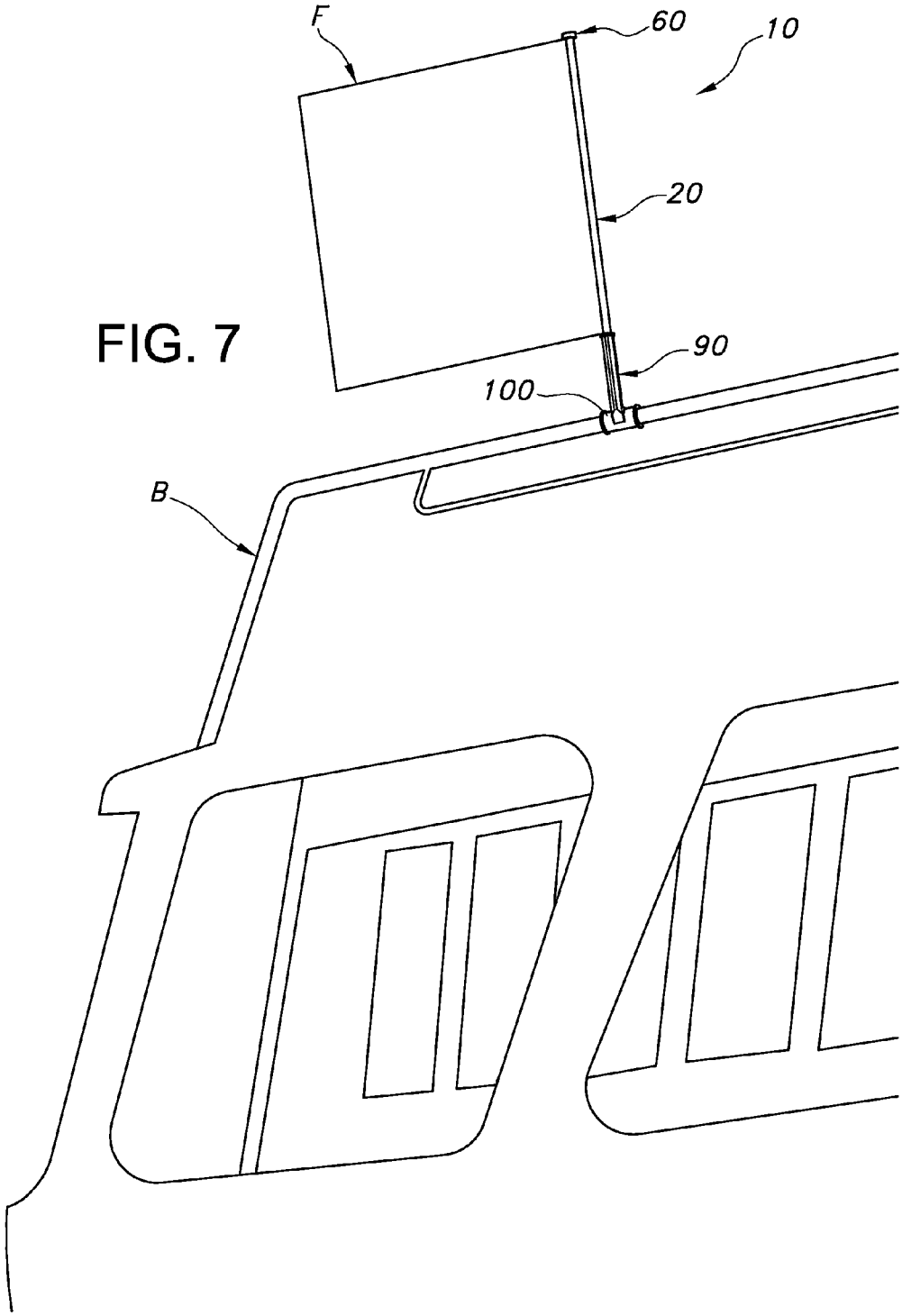
FIG. 7 is an isometric view of the instant invention mounted onto a partially represented boat with a flag secured thereon.

As seen in FIG. 7, clamp 100 mounts onto a structure of cooperative dimensions and shape on vessel B to display at least one flag F mounted on shaft assembly 20. Shaft assembly 20 has a substantially elongated cylindrical shape. Flag F can be any type of flag, of any shape and of any color. Flag F furthermore, can have any design, letter, number, or symbol, or combination thereof thereon. Vessel B can be any type vehicle, including but not limited to a sea vessel such as a boat or yacht; a land vehicle such as an automobile, truck, recreational vehicle, camper, motorcycle, SUV, etc; or aircraft.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A flagpole, comprising:

A) a shaft assembly comprising first and second ends, said first end having a head thereon, positioned between said head and said second end is a channel;

B) a snap cap comprising an exterior sidewall having a top face and an exterior bottom edge, an interior sidewall extends from said top face to an interior bottom wall, said interior bottom wall comprises an edge that protrudes inwardly a predetermined distance from said interior sidewall, at least two notches are defined at said top face, said at least two notches extend along said interior sidewall to said interior bottom wall; and C) a clamp assembly comprising a shaft member having third and fourth ends, said third end extends from said second end, extending from said fourth end is a connector section that terminates as a clamp, said clamp comprises first and second lateral ends, said first and second lateral ends have respective first and second lateral flanges, and each said respective first and second lateral flanges define a "C" shape.

2. The flagpole set forth in claim 1, further characterized in that said channel receives said edge when said snap cap is forced over said head with a predetermined force.

3. The flagpole set forth in claim 1, further characterized in that said clamp is perpendicular to said shaft assembly.

4. The flagpole set forth in claim 1, further characterized in that said clamp is perpendicular to said shaft member.

5. The flagpole set forth in claim 1, further characterized in that said exterior sidewall is parallel to said interior sidewall.

6. The flagpole set forth in claim 1, further characterized in that each said first and second lateral ends define a "C" shape.

7. The flagpole set forth in claim 1, further characterized in that said at least two notches are positioned opposite with respect to each other.

8. The flagpole set forth in claim 1, further characterized in that said clamp has a hatched section that defines a clamp interior face.

9. The flagpole set forth in claim 1, further characterized in that said clamp mounts onto a structure of cooperative dimensions and shape to display a flag mounted on said shaft assembly.

10. The flagpole set forth in claim 1, further characterized in that said shaft assembly has a substantially elongated cylindrical shape.

11. The flagpole set forth in claim 1, further characterized in that a threaded bolt protrudes from said second end.

12. The flagpole set forth in claim 1, further characterized in that said third end comprises a threaded hole.

13. The flagpole set forth in claim 1, further characterized in that said third end comprises a threaded hole that receives a threaded bolt protruding from said second end.

14. A flagpole, comprising:

A) a shaft assembly comprising first and second ends, said first end having a head thereon, positioned between said head and said second end is a channel;

B) a snap cap comprising an exterior sidewall having a top face and an exterior bottom edge, an interior sidewall extends from said top face to an interior bottom wall, said interior bottom wall comprises an edge that protrudes inwardly a predetermined distance from said interior sidewall, at least two notches are defined at said top face, said at least two notches extend along said interior sidewall to said interior bottom wall, said at least two notches are positioned opposite with respect to each other; and C) a clamp assembly comprising a shaft member having third and fourth ends, said third end extends from said second end, extending from said fourth end is a connector section that terminates as a clamp, said clamp comprises first and second lateral ends with respective first and second lateral flanges, said clamp has a hatched section that defines a clamp interior face.

15. The flagpole set forth in claim 14, further characterized in that said channel receives said edge when said snap cap is forced over said head with a predetermined force.

16. The flagpole set forth in claim 15, further characterized in that said clamp is perpendicular to said shaft assembly and said shaft member, said exterior sidewall is parallel to said interior sidewall.

17. The flagpole set forth in claim 16, further characterized in that each said first and second lateral ends and said respective first and second lateral flanges define a "C" shape.

* * * * *